US005552797A

United States Patent [19]

Cook

[11] Patent Number: 5,552,797

[45] Date of Patent: Sep. 3, 1996

[54] DIE-CASTABLE CORRUGATED HORNS PROVIDING ELLIPTICAL BEAMS

[75] Inventor: Scott J. Cook, Garner, N.C.

[73] Assignee: Avnet, Inc., Great Neck, N.Y.

[21] Appl. No.: 348,790

[22] Filed: Dec. 2, 1994

[51] Int. Cl.[6] ..... H01Q 13/02

[52] U.S. Cl. ..... 343/786; 343/772

[58] Field of Search ..... 343/786, 762, 343/772; H01Q 13/00, 13/02

[56] References Cited

U.S. PATENT DOCUMENTS

| | | | |
|---|---|---|---|
| 3,618,106 | 11/1971 | Bryant | 343/772 |
| 3,732,571 | 5/1973 | Neale | 343/786 |
| 3,924,237 | 12/1975 | Fletcher et al. | 343/786 |
| 3,936,837 | 2/1976 | Coleman et al. | 343/781 |
| 4,048,592 | 9/1977 | Drabowitch | 333/6 |
| 4,194,380 | 3/1980 | Brown et al. | 72/64 |
| 4,472,721 | 9/1984 | Mörz et al. | 343/786 |
| 4,636,798 | 1/1987 | Seavey | 343/753 |
| 4,658,258 | 4/1987 | Wilson | 343/786 |
| 4,902,988 | 2/1990 | Bruns et al. | 343/786 |
| 4,959,658 | 9/1990 | Collins | 343/786 |
| 5,086,304 | 2/1992 | Collins | 343/778 |
| 5,486,839 | 1/1996 | Rodeffer et al. | 343/786 |

FOREIGN PATENT DOCUMENTS

| | | | |
|---|---|---|---|
| 1008954 | 3/1952 | France | 343/786 |
| 3144319 | 5/1983 | Germany | 343/786 |
| 3146273 | 5/1983 | Germany | 343/786 |
| 2224603 | 5/1990 | United Kingdom . | |
| WO88/01444 | 2/1988 | WIPO . | |
| WO89/0950 | 10/1989 | WIPO . | |
| WO91/20109 | 12/1991 | WIPO . | |

OTHER PUBLICATIONS

W. F. Bahret et al., *IEE Transactions on Antennas And Propagation,* Jul. 1968, (494–495).

R. E. Lawrie et al., *IEE Transactions on Antennas And Propagation,* Sep. 1966 (605–610).

*Primary Examiner*—Hoanganh Le
*Attorney, Agent, or Firm*—Darby & Darby, P.C.

[57] ABSTRACT

A corrugated horn having ridges disposed on the inner surface of the horn, such that the ridges are oriented parallel to the horn axis, is adapted to provide elliptical beams. When the corrugated horn is circular, the elliptical beam is produced by changing the step heights and/or ridge heights around the circumference of the horn, which in turn changes the semi-flare angle, defined as the angle made by the horn axis and a line joining the top surfaces of the ridges. Because corrugated horns constructed according to this invention have ridges oriented parallel to the horn axis, these corrugated horns are readily manufactured using conventional die casting methods or numerical machining techniques.

22 Claims, 6 Drawing Sheets

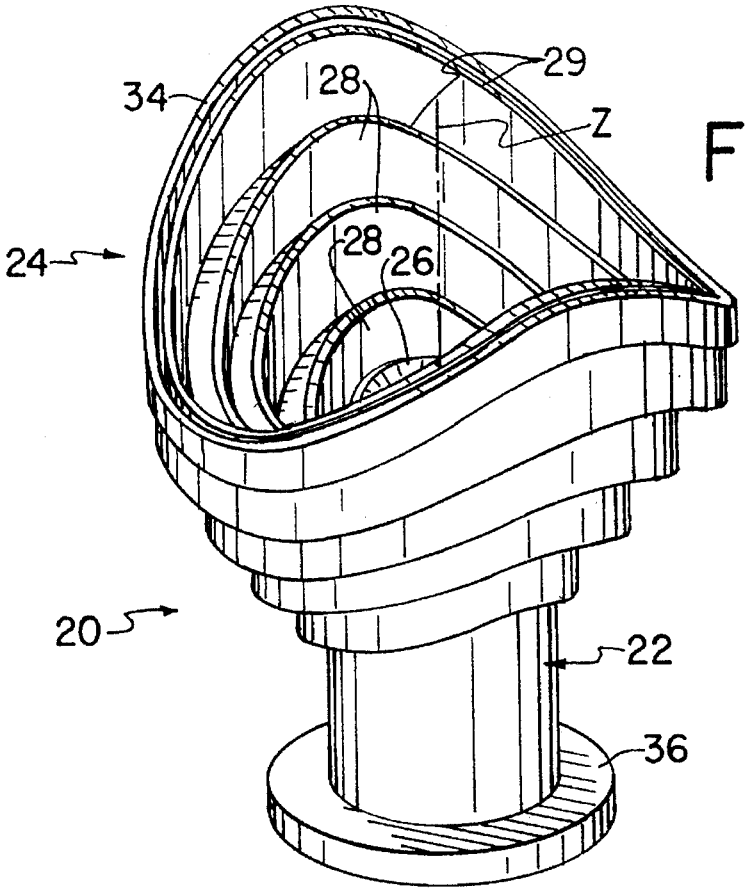
FIG. 1
FIG. 2
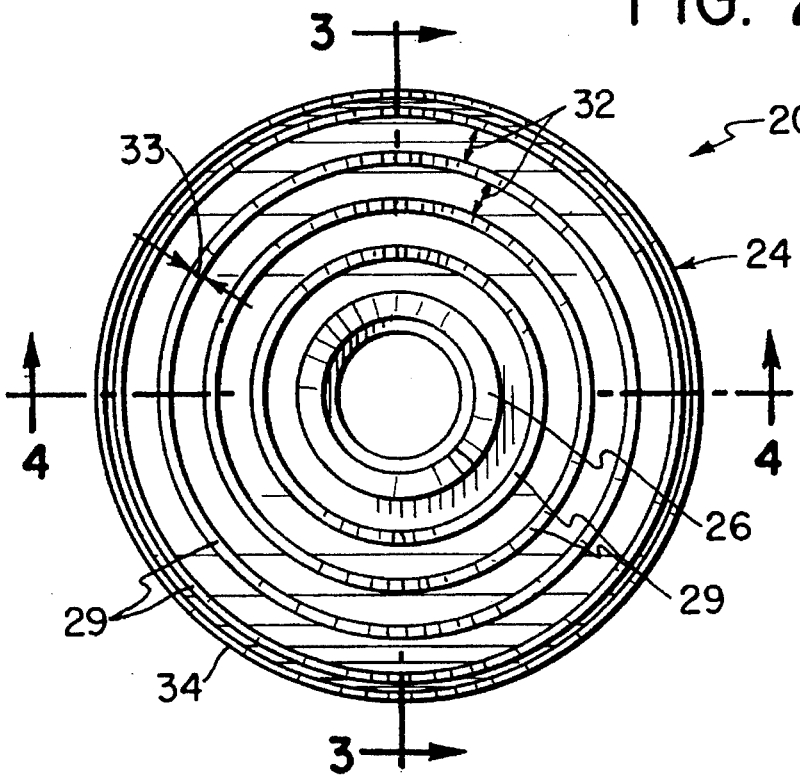

DIE-CASTABLE CORRUGATED HORNS PROVIDING ELLIPTICAL BEAMS

This invention relates to corrugated horns, and more particularly, to corrugated horns which produce elliptical beams that are feasible to manufacture using conventional die-casting methods.

BACKGROUND OF THE INVENTION

Circular and elliptical corrugated horns are known in the art. Circular corrugated horns provide an antenna with low side and back lobes, a rotationally symmetric radiation pattern and broad band performance. For example, U.S. Pat. No. 3,618,106 to Bryant teaches the use of a corrugated wave guide to form antenna feed horns. The corrugations extend throughout the length of the horn, and both the cross-sectional dimensions of the horn and the height of the corrugations are tapered to achieve broad bandwidth and good impedance match at each end of the horn. The exact guidelines for the relationship between flare angle and beamwidth are given in CLARRICOATS, P. J. B. & OLVER, A. D., *Corrugated Horns for Microwave Antennas,* (Peter Peregrinus, Ltd., 1984) and are incorporated by reference herein.

Elliptical corrugated wave guides are becoming increasingly popular to produce elliptically contoured beams with high polarization purity. However, elliptical corrugated horns are costly to manufacture because they are difficult to machine, and impractical to die cast as a single unit. This is primarily because the ridges are oriented at an angle with respect to the horn axis which makes die casting impractical.

A die-castable corrugated horn, with the ridges being oriented parallel to the horn axis, has previously been developed. However, in that construction, the corrugated horn is circular and only provides a circular beam. It is believed that no readily die-castable, elliptical, corrugated horn is commercially available and that the only available elliptical corrugated horns are costly to manufacture because of the orientation of the ridges relative to the horn axis.

The object of this invention is to provide a die-castable, or otherwise easily machined, corrugated horn that provides an elliptical beam for use with an elliptical antenna.

A further object of this invention is to provide a die-castable corrugated horn that provides non-circular and/or non-symmetrical beams for a variety of antenna applications.

SUMMARY OF THE INVENTION

The present invention is directed to a corrugated horn which provides elliptical and other non-circular beams over a narrow or wide frequency band, and which is die-castable or otherwise easily numerically machined. The horn portion includes circumferential ridges oriented so that they lie parallel to the horn axis, as opposed to perpendicular, or at some other angle with respect to the horn axis. According to this invention, the horn may easily be designed to have a desired beam shape and phase center for any linear or circular polarity across a wide frequency band.

In an illustrative embodiment of the invention, a circular contoured corrugated ("CCC") horn having a plurality of ridges disposed on the inner surface of the horn, has the ridges oriented parallel to the horn axis. Each ridge is separated from the next ridge by a vertical distance or step height and a horizontal distance or slot width. The height of adjacent ridges and/or the step heights between adjacent ridges vary in phase with each other around the circumference of the CCC horn. This causes the CCC horn to have an undulating top surface. This undulating top surface changes the semi-flare angle, defined as the angle between a line parallel to the z axis and a line joining the top surfaces of the ridges, around the circumference of the horn and thereby provides an elliptical beam, or some other non-circular beam.

In an alternative embodiment, the non-circular beam is provided by maintaining a constant ridge height and step height, but with varying slot widths and/or ridge widths around the circumference of the corrugated horn. The varying slot and/or ridge widths cause the semi-flare angle to vary around the circumference of the corrugated horn. The horn, therefore, provides an elliptical or otherwise non-circular beam. In the preferred embodiment, at least one of (a) the ridge heights, (b) the step heights, (c) the slot widths, and (d) the ridge widths is varied. The resulting horn is both contoured (undulating top surface) as well as non-circular (elliptical, race track, rectangular, etc.). Hence, the semi-flare angle changes around the circumference of the corrugated horn, providing a desired non-circular beam. According to this invention, each illustrative embodiment provides a die-castable corrugated horn, because the ridges are oriented parallel to the horn axis.

BRIEF DESCRIPTION OF THE DRAWINGS

The foregoing and other features of the present invention will be more readily apparent from the following detailed description and drawings of illustrative embodiments of the invention in which:

FIG. 1 is a perspective view of a contoured circular corrugated horn;

FIG. 2 is a plan view of FIG. 1;

DESCRIPTION OF ILLUSTRATIVE EXEMPLARY EMBODIMENTS

Figure 3:
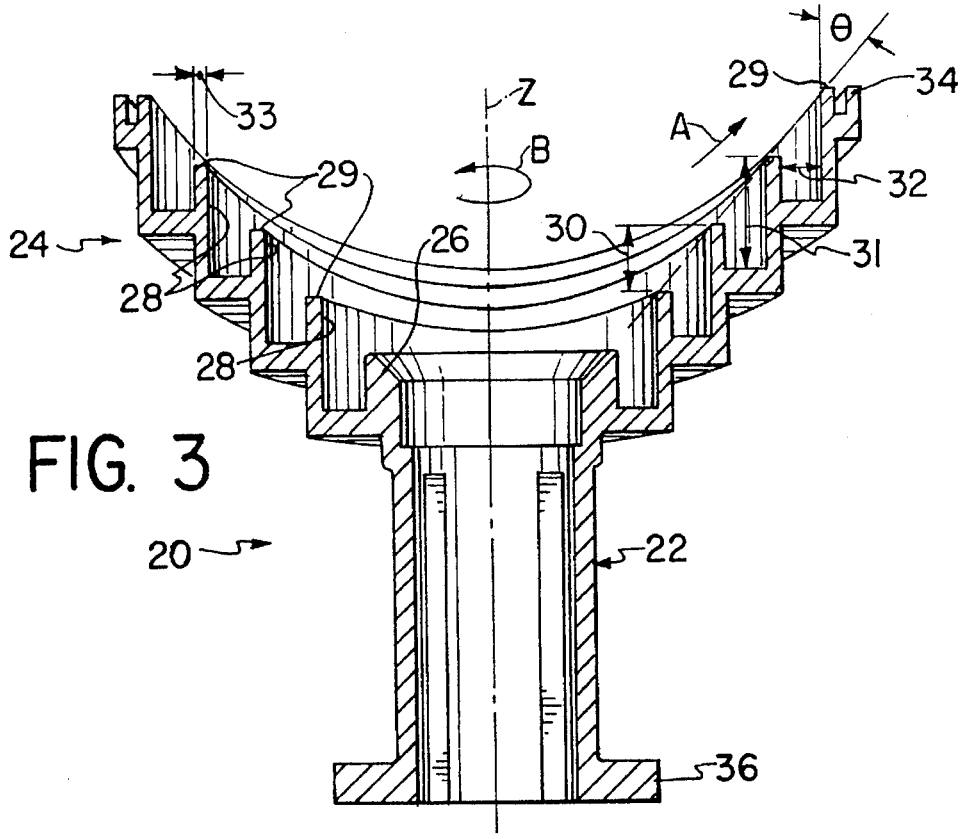
FIG. 3 is a cross-sectional view from 3—3 of FIG. 2.
Figure 4:
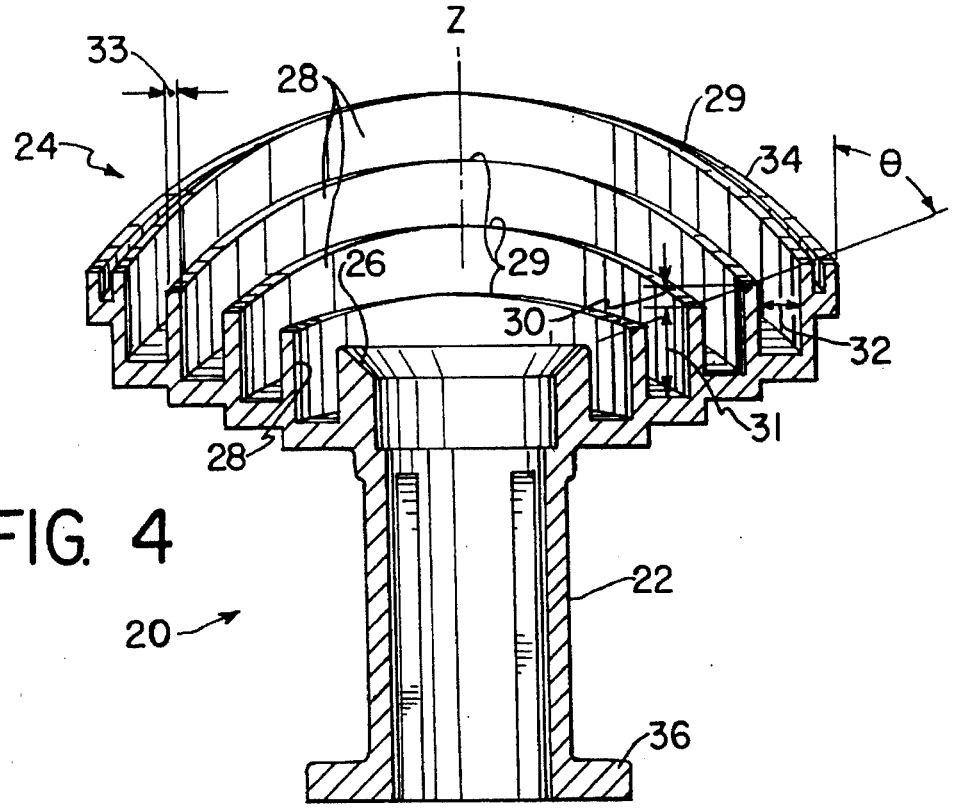
FIG. 4 is a cross-sectional view from 4—4 of FIG. 2.
Figure 5:
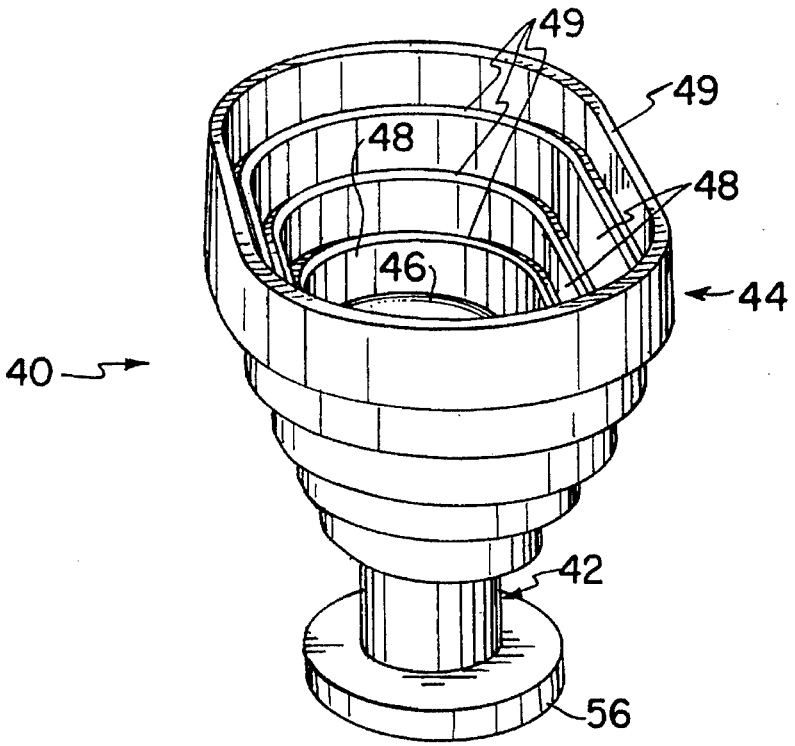
FIG. 5 is a perspective view of a non-circular corrugated horn.

An illustrative embodiment of the invention is shown in FIGS. 1–4. The circular contoured corrugated ("CCC") horn 20 is preferably constructed of zinc. However, any conductive material like aluminum, brass, copper or metalized plastic may be used. The CCC horn comprises a wave guide 22 having two ends which are referred to herein as upper and a lower ends. The upper end of the wave guide 22 opens into a horn 24. The wave guide 22 and the horn 24 are radially disposed about a horn axis z. A plurality of ridges 28 are disposed upon the inner surface of the horn 24, each ridge being oriented parallel to the horn axis z. The shape of the ridges 28 is not critical to this invention and may be rounded, square or triangular, etc. A transition section 26 is located towards the bottom end of the horn 24 and provides a transition from the wave guide 22 to the horn 24. Each of the ridges 28 is located at specified stepped intervals along the inner surface of the horn 24 in the direction of arrow A, with the top surface 29 of the uppermost ridge 28 defining the top surface of the horn 24. Each of these "steps" has both a vertical dimension referred to herein as the step height 30, and a horizontal dimension referred to herein as the slot width 32.

The horn 24 is "flared" at an angle called the semi-flare angle θ, defined as the angle between a line drawn parallel to the horn axis z, and a line passing through the top surfaces 29 of adjacent ridges 28. It is the semi-flare angle θ that controls the beamwidth provided by the CCC horn 20, with wider beamwidths being provided by using larger semi-flare angles θ. According to the invention, each ridge 28, varies in height (dimension 31) around the circumference of the horn 24 in the direction of arrow B (FIG. 3). The step heights 30 also vary around the circumference of the horn 24. The changing ridge heights 31 and step heights 30 result in a uniformly undulating top surface 29, and a varying semi-flare angle θ around the circumference of the horn 24 (Compare FIGS. 3 and 4). The changing semi-flare angle θ results in the beamwidth changing around the Z-axis, causing the CCC horn 20 to emit an elliptical or otherwise non-circular beam. The ridge heights 31 and step heights 30 are changed within a specified range depending on the required semi-flare angle θ to produce a beam of the desired shape.

It will be understood that the term "elliptical," as used herein, is not limited to a shape meeting the mathematical criteria of a true ellipse, but rather, is used to include other non-circular, generally oval, shapes. According to this invention, the varying ridge heights 31 and/or step heights 30 may be used to provide a beam with any non-circular shape. For example, a race track, a rounded rectangle, a rhombus with rounded corners, or an amoeboid shape with no symmetry are all included in the term "non-circular."

The relationship between the semi-flare angle and the beamwidth no longer conform to the tables given in Clarricoats & Olver's book, *Corrugated Horns for Microwave Antennas* (1984). This is because a wide-angled CCC horn 20 designed to provide an elliptical beam, provides a narrower beamwidth than a conventional, non-contoured circular corrugated horn of the same semi-flare angle θ, designed to provide a circular beam. Also, a CCC horn 20 having a small semi-flare angle θ would produce a beam that is wider than the beam provided by a conventional, non-contoured circular corrugated horn.

Although the transition section 26 is shown as a circle of uniform height 31 around the circumference of the horn 24, the transition section 26 may also be contoured and/or non-circular, where such contouring and/or shaping is required to produce a particular elliptical or other non-circular beam. An optional lip 34 is attached to the outer surface of the horn 24. This provides a means for attaching a protective cover (not shown) over the CCC horn 20. An optional flange like base 36 may be attached to the lower end of the wave guide 22 to provide securing means for the CCC horn 20.

Figure 7:
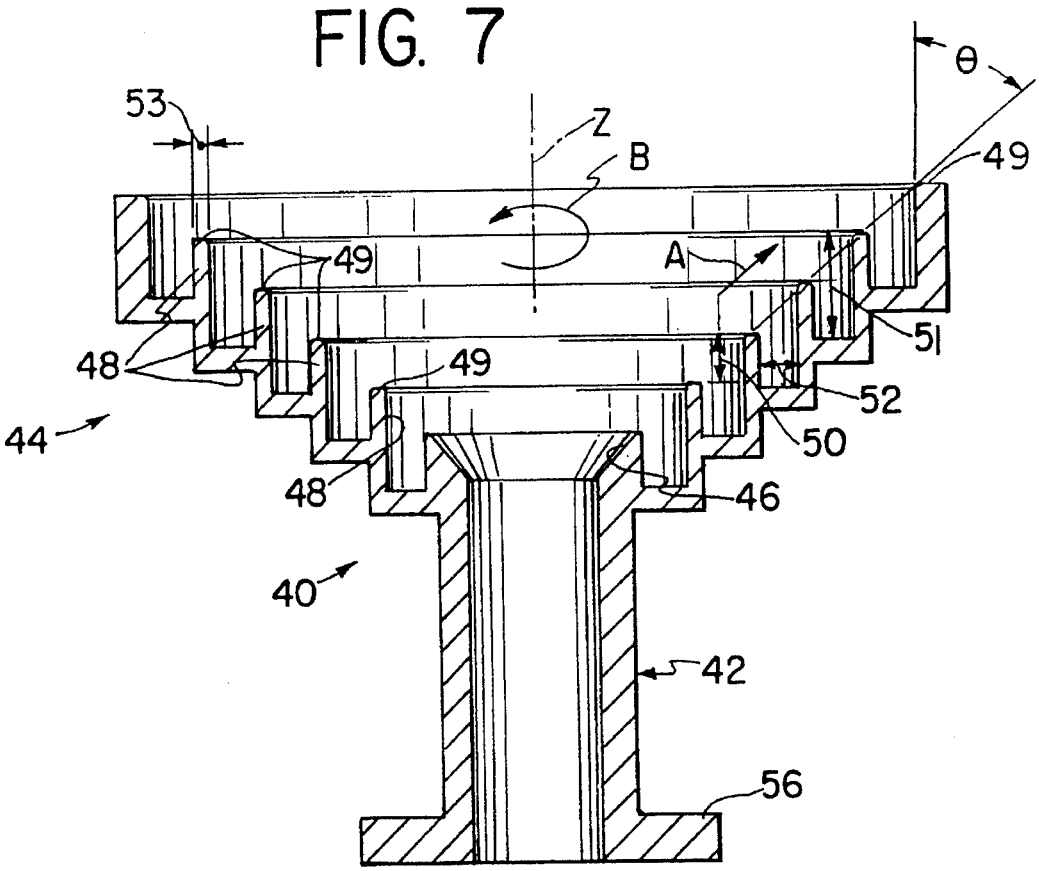
FIG. 7 is a cross-sectional view from 7—7 of FIG. 6.

In an illustrative example of the CCC horn 20 shown in FIGS. 1–4, each ridge 28 varied in height 31 between 0.498 inch (FIG. 3) and 0.395 inch (FIG. 4) around the circumference of horn 24 in the direction of arrow B. The step heights 30 varied between 0.295 inch (FIG. 3) and 0.090 inch (FIG. 4) around the circumference of the horn 24. As a result of the changing ridge heights and step heights, the semi-flare angle varied between 40° (FIG. 3) and 70° (FIG. 7), and thereby provided the desired elliptical beam. Of course, these dimensions are merely illustrative. All that is required is that the step heights 30 and/or ridge heights 31 vary sufficiently to change the semi-flare angle θ so as to cause the CCC horn 20 to provide the desired non-circular beam. The ridge heights 31 and step heights 30 are shown to vary in phase with successive ridges 28. However, this is not required by the present invention. The ridge heights 31 and/or step heights 30 may vary independently of adjacent ridges 28 and still produce an undulating top surface 29 sufficient to provide the required non-circular beam.

A further advantage of a CCC horn 20 constructed according to this invention is that, because each ridge 28 is aligned parallel to the horn axis z, as opposed to perpendicular, or at some other angle with respect to the horn axis z, the CCC horn 20 may readily be die casted in accordance with known die casting methods. Also, the parallel aligned ridges 28 facilitates other manufacturing methods, for example, other casting methods or numerical machining techniques.

FIGS. 5–8 illustrate a non-circular corrugated ("NC") horn 40 which also provides an elliptical beam or non-circular beam for use with elliptical and other non-circular antennas. The NC horn 40 comprises a wave guide 42 having a lower end and an upper end. The upper end of the wave guide 42 opens into a horn 44. The wave guide 42 and the horn 44 are disposed about a horn axis z. As with the CCC horn 20, a plurality of ridges 48 are disposed upon the inner surface of the horn 44, with each ridge being oriented parallel to the horn axis z. This allows the NC horn 40 to be readily constructed via known die casting methods. A transition section 46 is located at the bottom end of the horn 44, and provides a transition from the wave guide 42 to the horn 44. Each of the other ridges 48 is located at specified stepped intervals along the inner surface of the horn 44 in the direction of arrow A, with the top surface 49 of the uppermost ridge 48 defining the top surface of the horn 44. Each of these "steps" has both a vertical dimension or step height 50, and a horizontal dimension or slot width 52.

Unlike the CCC horn 20, the ridge heights 51 and the step heights 50 are constant around the surface of horn 44. According to this embodiment of the invention, the slot widths 52 and/or the ridge widths 53 may be changed within a specified range around the circumference of the horn 44 in the direction of arrow B. The range within which the slot widths 52 and/or the ridge width 53 may vary depends on the desired shape of the NC horn 40, and ultimately on the desired elliptical or otherwise non-circular beam to be emitted. The electrical and mechanical guidelines for the slot width 52 and the ridge widths 53 for circular corrugated horns given in Clarricoats & Olver's book, *Corrugated Horns for Microwave Antennas* (1984), apply reasonably well to the non-circular corrugated horns 40. These guidelines may, therefore, be used for determining the slot width 52 and ridge width 53 dimensions. By varying the slot widths 52 and/or the ridge widths 53, the horn 44 is non-circular as viewed from the front of the NC horn 40 looking down the z axis towards the wave guide 42. The changing slot widths 52 and/or ridge widths 53 cause the semi-flare angle θ to change around the circumference of the horn 44 in the direction of arrow B. It is the changing semi-flare angle θ that provides an elliptical beam or a non-circular beam, as desired.

Although the transition section 46 is shown as a ridge of uniform height 51 around the circumference of the horn 44, the transition section 46 may also be contoured where such contouring is required to produce a particular elliptical or other non-circular beam. An optional flange like base 56 may be attached to the lower end of the wave guide 42 to provide securing means for the NC horn 20.

Figure 6:
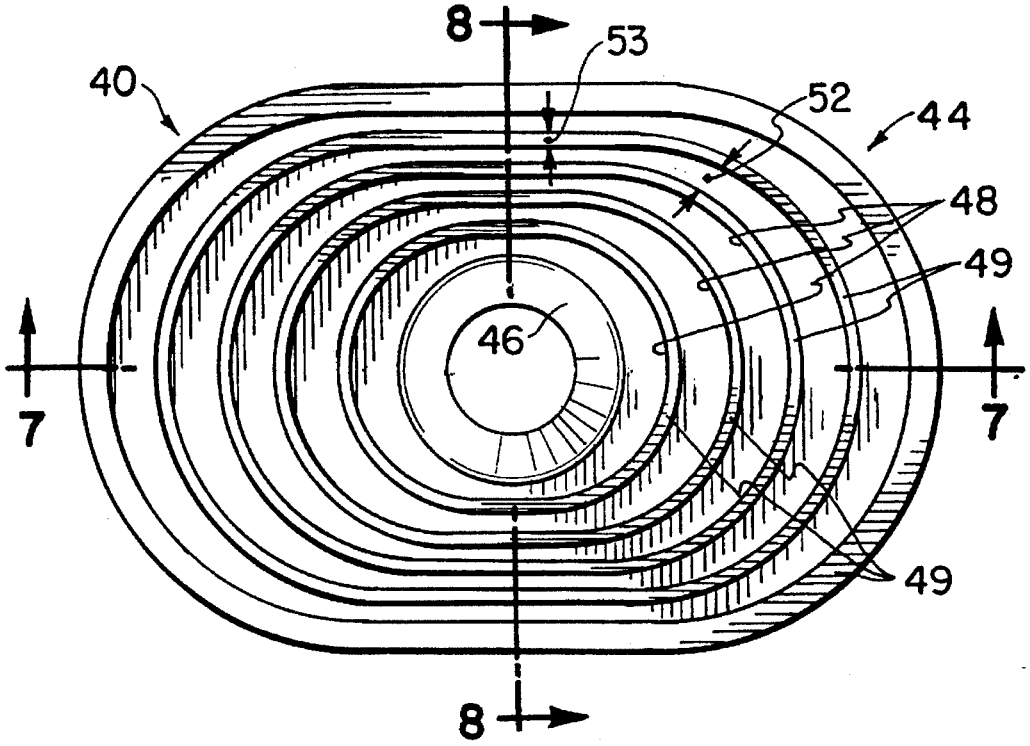
FIG. 6 is a plan view of FIG. 5.
Figure 8:
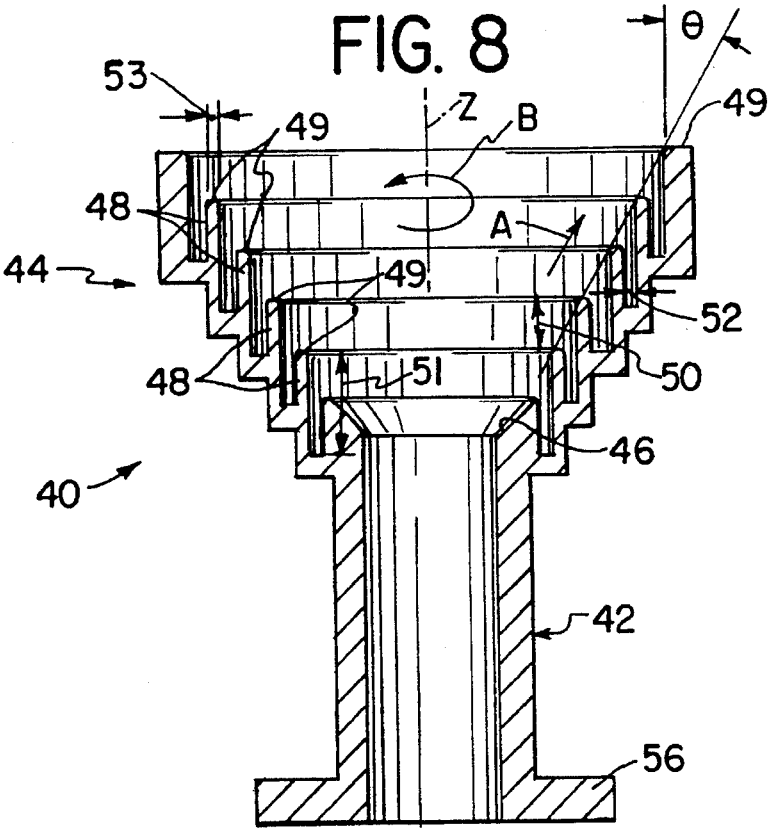
FIG. 8 is a cross-sectional view from 8—8 of FIG. 6.
Figure 9:
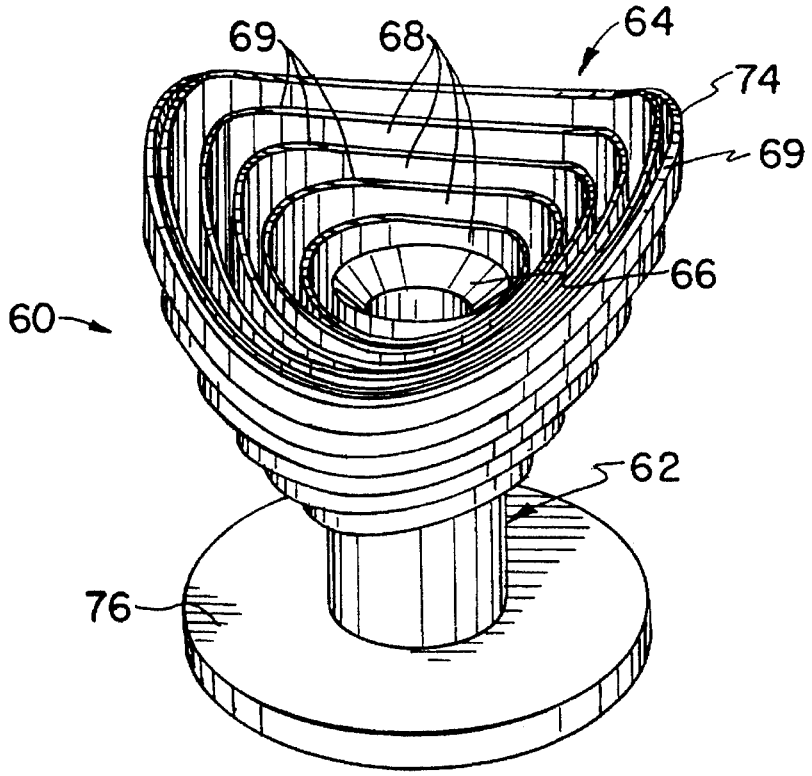
FIG. 9 is a perspective view of a non-circular contoured corrugated horn.
Figure 10:
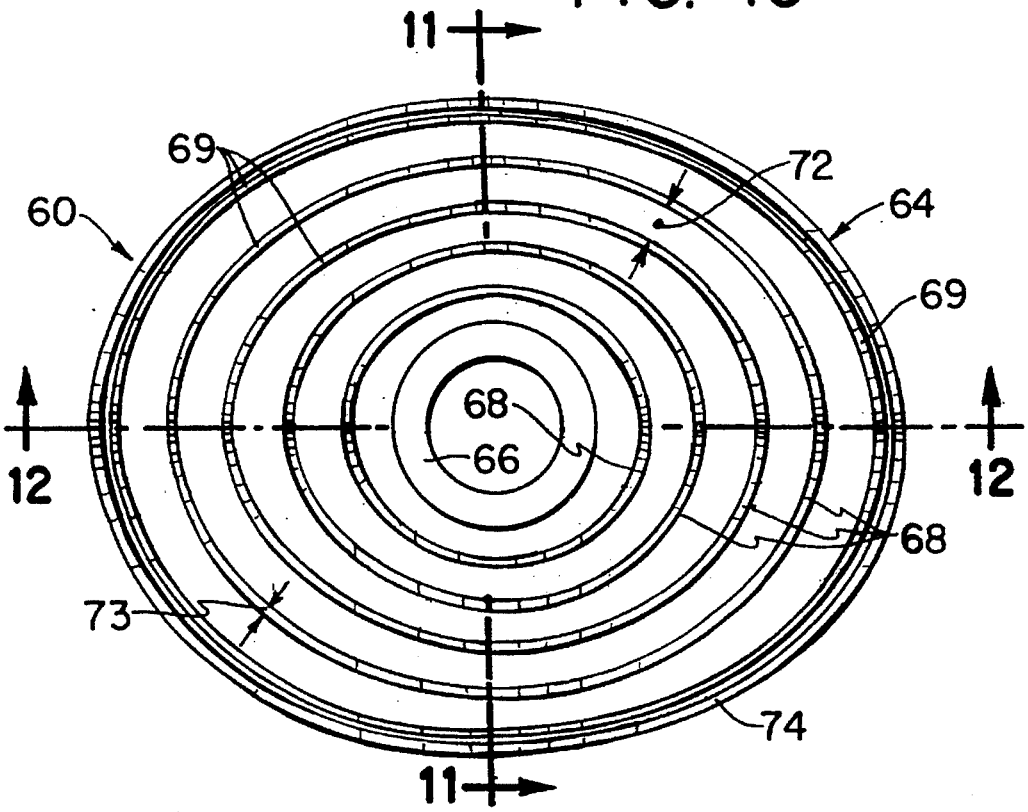
FIG. 10 is a plan view of FIG. 9.
Figure 11:
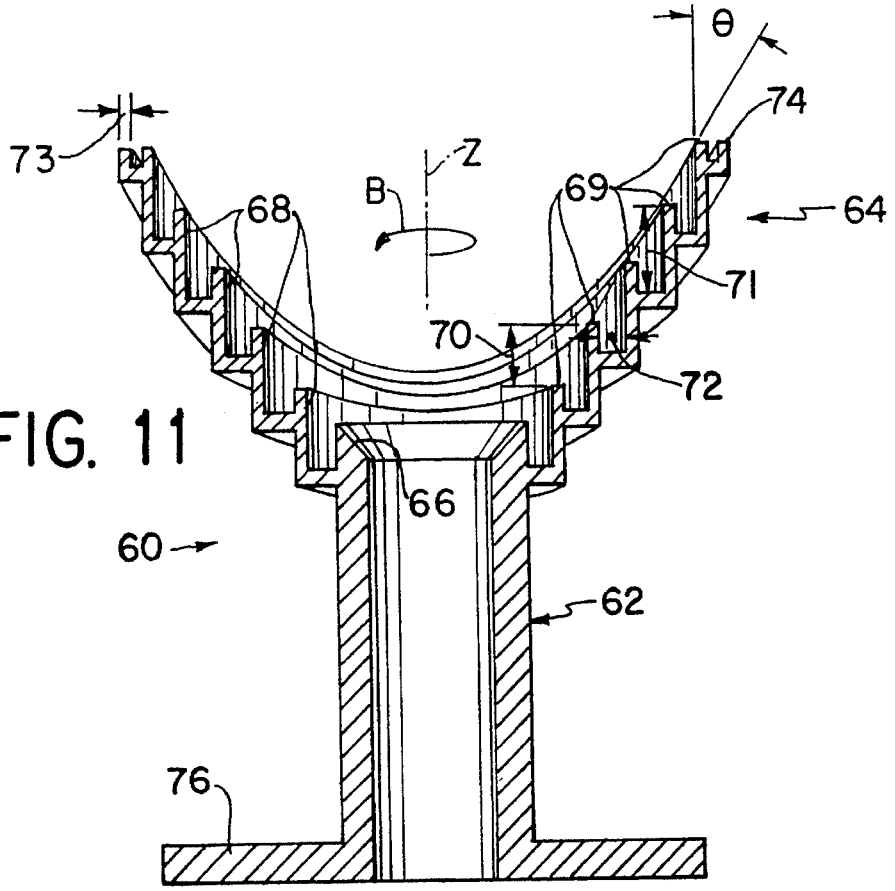
FIG. 11 is a cross-sectional view from 11—11 of FIG. 10.

In the illustrative example of the embodiment shown in FIGS. 5–8, the ridge width 53 was constant at 0.060 inch, while the adjacent slot widths 52 varied in phase with each other between 0.305 inch (FIG. 7) and 0.132 inch (FIG. 8). This gave the horn 44 its non-circular shape (FIG. 6). Although the ridge heights 51 and step heights 50 remained constant, the changing slot widths 52 caused the semi-flare angle θ to change between 44.1° (FIG. 7) and 27° (FIG. 8) around the circumference of the horn 44, causing the NC horn 40 to emit the desired non-circular beam. It is again emphasized that all dimensions given are strictly for illustrative purposes. The slot widths 52 must only vary within a range sufficient to change the semi-flare angle θ the amount required to provide the required elliptical beam. Further, there is no requirement that successive ridges 48 vary in phase with each other. It is entirely within the scope of this invention for the slot widths 52 and/or the ridge widths 53 to vary independent of the ridge widths of adjacent ridges 48 and the corresponding adjacent slot widths 52.

As noted above, the transition section 46 and the ridges 48 are all oriented parallel to the horn axis z. This parallel orientation provides a NC horn 40 that is readily constructed through known die casting techniques.

The preferred embodiment of the invention is illustrated in FIGS. 9–12. A non-circular contoured corrugated ("NCC") horn 60 comprises a wave guide 62 having a lower end and an upper end. The upper end of the wave guide 62 opens into a horn 64. The wave guide 62 and the horn 64 are radially disposed about a horn axis z. A plurality of ridges 68 are disposed upon the inner surface of the horn 64, each ridge being oriented parallel to the horn axis z. A transition section 66 is located at the bottom of the horn 64 and provides a transition from the wave guide 62 to the horn 64. Each of the ridges 68 is located at specified stepped intervals along the inner surface of the horn 64 in the direction of arrow A, with the top surface 69 of the uppermost ridge 68 defining the top surface of the horn 64. Each of these "steps" has both a vertical dimension or step height 70, and a horizontal dimension or slot width 72.

The horn 64 is "flared" at the semi-flare angle θ, defined as the angle between a line drawn parallel to the horn axis z, and a line passing through the top surfaces 69 of adjacent ridges 78. The nature of the beam emitted is a function of the semi-flare angle θ, and thus, by varying the semi-flare angle the desired elliptical beam may be emitted by the NCC horn 60. According to this embodiment of the invention, a desired elliptical beam may be provided by changing one or more of: (a) the ridge heights 71 of each ridge 68 around the circumference of the horn 64; (b) the step heights 70 between successive ridges 68; (c) the slot width 72 between successive ridges 68; and/or the ridge width 73 of successive ridges 68. In the illustrated preferred embodiment, adjacent ridges 68 are changed in phase with each other resulting in a horn 64 that is both undulating and non-circular. The ridge heights 71 and step heights 70 vary within a range sufficient to provide the desired contoured or undulating shape of the horn 64. The slot widths 72 also vary within a range sufficient to provide the desired non-circular shape of the horn 64. This desired shape determines the manner in which the semi-flare angle θ will change around the circumference of the horn 64 in the direction of arrow B, and will thus determine the nature of the beam emitted. According to this invention, the desired beam could be any non-circular beam to include an elliptically shaped beam, a race track shaped beam, a rectangular or rhomboidal shaped beam with rounded edges, or a completely non-symmetrically shaped beam.

Although the transition section 66 is shown as a ridge of uniform height around the circumference of the horn 64, the transition section 66 may also be contoured in phase with the ridges 68 where it is required to produce a particular non-circular beam. An optional lip 74 may be attached to the outer surface of the horn 64. This provides a means for attaching a protective cover (not shown) over the NCC horn 60. An optional flange like base 76 may be attached to the lower end of the wave guide 62 to provide securing means for the NCC horn 60.

Figure 12:
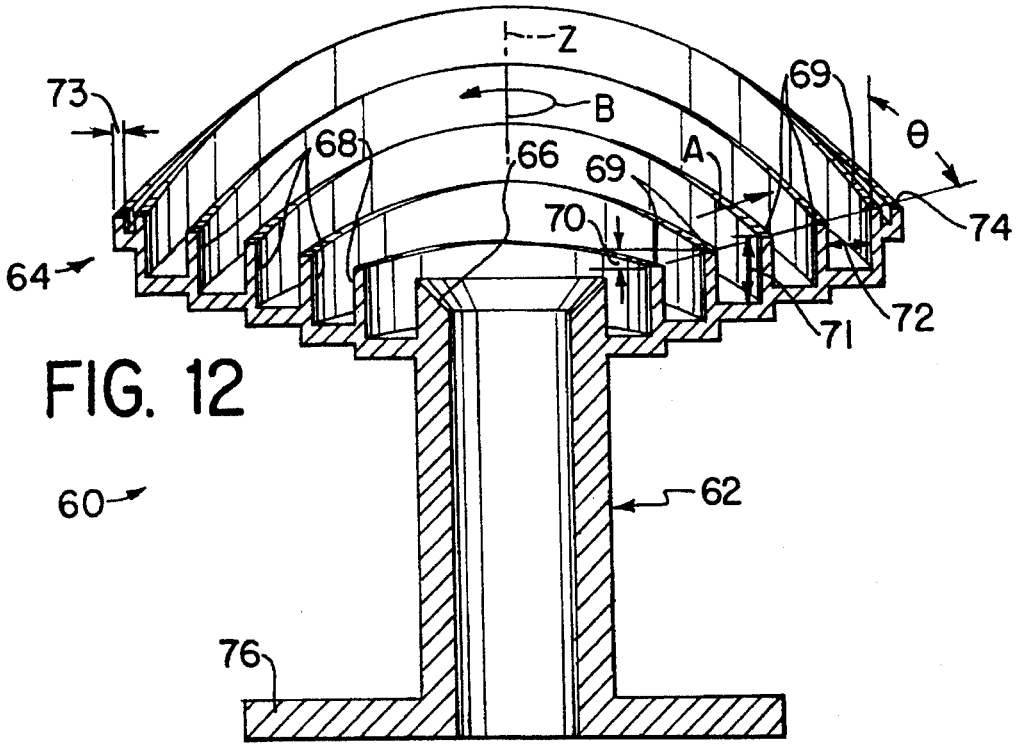
FIG. 12 is a cross-sectional view from 12—12 of FIG. 10.

In an illustrative example of the preferred embodiment of the NCC horn 60 shown in FIGS. 9–12, the ridge heights 71 varied between 0.496 inch (FIG. 11) and 0.373 inch (FIG. 12); the step heights 70 varied between 0.333 inch (FIG. 11) and 0.086 inch (FIG. 12); and the slot widths 72 varied between 0.156 inch and 0.259 inch around the circumference of the horn 64 in the direction of arrow B. The ridge widths 73 were not varied. As a result of the changing ridge heights 71, step heights 70, and slot widths 72, the semi-flare angle θ varied between 33° (FIG. 11) and 75° (FIG. 12).

Like the CCC horn 20 and the NC horn 40, the NCC horn 60 has the further advantage of being readily constructed by known die casting methods or other numerical machining methods because the ridges 68 are oriented parallel to the horn axis z.

While the invention has been particularly shown and described with reference to preferred embodiments thereof, it will be understood by those skilled in the art that various changes in form and details may be made therein without departing from the spirit and scope of the invention.

I claim:

1. A die cast, corrugated horn, radially disposed about a horn axis, and having an inner surface an outer surface and a top surface, comprising:

a plurality of ridges disposed upon the inner surface of the corrugated horn, each ridge having a horizontal ridge width and a vertical ridge height, and being oriented parallel to the horn axis, with the ridges being located at stepped intervals along the inner surface of the corrugated horn, the stepped intervals having a vertical step height, and a horizontal slot width;

the corrugated horn having a semi-flare angle, defined as the angle between a line drawn parallel to the horn axis and a line passing through the top surfaces of adjacent ridges, the semi-flare angle changing circumferentially around the mouth of the horn so that the corrugated horn emits a non-circular beam.

2. The corrugated horn described in claim 1 wherein the semi-flare angle is varied by changing the ridge height of at least one ridge around the circumference of the corrugated horn an amount sufficient to produce a desired non-circular beam.

3. The corrugated horn described in claim 1 wherein the semi-flare angle is varied by changing the slot widths between successive ridges around the circumference of the corrugated horn an amount sufficient to produce a desired non-circular beam.

4. The corrugated horn described in claim 1 wherein the semi-flare angle is varied by changing the ridge widths of successive ridges around the circumference of the corrugated horn an amount sufficient to produce a desired non-circular beam.

5. The corrugated horn described in claim 1 wherein the semi-flare angle is varied by changing the step height between successive ridges around the circumference of the corrugated horn an amount sufficient to produce a desired non-circular beam.

6. The corrugated horn described in claim 1 wherein the semi-flare angle is varied by changing at least one of (a) the slot widths between successive ridges around the circumference of the corrugated horn, (b) the ridge width of each ridge around the circumference of the corrugated horn, (c) the ridge height of each ridge around the circumference of the corrugated horn, and (d) the step height between successive ridges around the circumference of the corrugated horn, an amount sufficient to produce a desired non-circular beam.

7. The corrugated horn described in claim 6 wherein at least one of (a) the ridge height of at least one ridge, and (b) the step height between successive ridges varies around the circumference of the corrugated horn.

8. The corrugated horn described in claim 7 wherein the ridge heights, and/or the step heights vary in phase with each other.

9. The corrugated horn described in claim 6 wherein at least one of (a) the ridge width and (b) the slot width varies around the circumference of the corrugated horn.

10. The corrugated horn described in claim 9 wherein the ridge widths and/or the slot widths vary in phase with each other.

11. The corrugated horn described in claim 6 wherein at least one of (a) the ridge height of at least one ridge, and (b) the step height between successive ridges varies around the circumference of the corrugated horn, and at least one of (a) the ridge width and (b) the slot width varies around the circumference of the corrugated horn.

12. The corrugated horn described in claim 11 wherein the ridge heights, ridge widths, step heights, and/or the slot widths vary in phase with each other.

13. The corrugated horn described in claim 1 wherein the top surface of each ridge is not perpendicular to the horn axis.

14. The circular corrugated horn described in claim 1 wherein the ridge height of at least one of the ridges varies around the circumference of the circular corrugated horn, so that the circular corrugated horn has an undulating top surface.

15. The circular corrugated horn described in claim 14 wherein the ridge heights of successive ridges vary in phase with each other.

16. The circular corrugated horn described in claim 1 wherein the step height between successive ridges varies around the circumference of the circular corrugated horn, so that the circular corrugated horn has an undulating top surface.

17. The circular corrugated horn described in claim 16 wherein the step heights between successive ridges vary in phase with each other.

18. A non-circular corrugated horn having an inner surface, an outer surface, and a top surface, and being radially disposed about a horn axis, comprising, a plurality of ridges disposed on the inner surface, each ridge having a horizontal ridge width and a vertical ridge height, and being oriented parallel to the horn axis, with the ridges being located at stepped intervals along the inner surface of the corrugated horn, the stepped intervals having a vertical step height, and a horizontal slot width, wherein the slot width changes around the circumference of the non-circular corrugated horn such that a semi-flare angle, defined as the angle between a line drawn parallel to the horn axis and a line passing through the top surfaces of adjacent ridges, changes around the circumference of the non-circular corrugated horn.

19. The non-circular corrugated horn as described in claim 18 wherein the ridge widths vary around the circumference of the non-circular corrugated horn such that a semi-flare angle changes around the circumference of the non-circular corrugated horn.

20. The non-circular corrugated horn as described in claim 18 wherein the ridge height of at least one of the ridges varies around the circumference of the circular corrugated horn, so that the non-circular corrugated horn has an undulating top surface.

21. The non-circular corrugated horn as described in claim 18 wherein the step height between successive ridges varies around the circumference of the circular corrugated horn, so that the non-circular corrugated horn has an undulating top surface.

22. The non-circular corrugated horn as described in claim 18 wherein the ridge heights, ridge widths, slot widths, and the step heights vary in phase with each other.

* * * * *